US010184466B2

(12) United States Patent
Wu

(10) Patent No.: US 10,184,466 B2
(45) Date of Patent: Jan. 22, 2019

(54) AIR PUMP INCLUDING STORAGE TANK INCLUDING OUTLET PORT ADAPTED TO BE OPENED/CLOSED AUTOMATICALLY

(71) Applicant: Scott Wu, Taichung (TW)

(72) Inventor: Scott Wu, Taichung (TW)

( * ) Notice: Subject to any disclaimer, the term of this patent is extended or adjusted under 35 U.S.C. 154(b) by 4 days.

(21) Appl. No.: 15/461,763

(22) Filed: Mar. 17, 2017

(65) Prior Publication Data

US 2018/0266408 A1 Sep. 20, 2018

(51) Int. Cl.

| | |
|---|---|
| ***F04B 39/10*** | (2006.01) |
| ***F04B 33/00*** | (2006.01) |
| ***F04B 41/02*** | (2006.01) |
| *F04B 39/12* | (2006.01) |

(52) U.S. Cl.

CPC ..... *F04B 39/10* (2013.01); *F04B 33/005* (2013.01); *F04B 41/02* (2013.01); *F04B 39/123* (2013.01); *Y10T 137/86035* (2015.04)

(58) Field of Classification Search

CPC ..... F04B 49/22; F04B 33/005; F04B 41/02; F04B 53/10; Y10T 137/86035

See application file for complete search history.

(56) References Cited

U.S. PATENT DOCUMENTS

| | | | | |
|---|---|---|---|---|
| 6,257,849 | B1 * | 7/2001 | Wu | F04B 33/005 417/238 |
| 6,893,232 | B2 * | 5/2005 | Wu | F04B 33/005 417/547 |
| 8,109,745 | B2 * | 2/2012 | Wu | F04B 33/005 417/234 |
| 8,721,296 | B1 * | 5/2014 | Wang | F04B 33/005 137/565.15 |
| 8,905,055 | B2 * | 12/2014 | Greene, III | F16K 17/042 137/12 |
| 2010/0096028 | A1 * | 4/2010 | Qiu | F16K 15/026 137/538 |
| 2014/0193276 | A1 * | 7/2014 | Hanson | F04B 33/005 417/53 |
| 2015/0211500 | A1 * | 7/2015 | Kumazawa | F04B 1/182 137/471 |

FOREIGN PATENT DOCUMENTS

| | | |
|---|---|---|
| TW | I542786 B | 7/2016 |

* cited by examiner

*Primary Examiner* — Craig Schneider
*Assistant Examiner* — Kevin Barss
(74) *Attorney, Agent, or Firm* — Alan D. Kamrath; Kamrath IP Lawfirm, P.A.

(57) ABSTRACT

An air pump includes a pumping system, a storage tank, a discharge passage, and a valve. The discharge passage includes a first section and a second section wider than the first section. The valve is movable in the discharge passage. The valve, disposed in a first position, includes a first seal end disposed in the first section and abutting a periphery thereof and includes a second seal end disposed in the second section and abutting a periphery thereof. The valve, disposed in a second position, includes the first seal end disengaging from the first section and not abutting the periphery thereof and includes the second seal end disposed in the second section and abutting the periphery thereof. The first and second seal ends respectively have first and second cross-sectional areas. The ratio of the second cross-sectional area to the first cross-sectional area is at least 2 to 1.

17 Claims, 4 Drawing Sheets

AIR PUMP INCLUDING STORAGE TANK INCLUDING OUTLET PORT ADAPTED TO BE OPENED/CLOSED AUTOMATICALLY

BACKGROUND OF THE INVENTION

1. Field of the Invention

The present invention relates to an air pump and, particularly, to an air pump including a storage tank including an outlet port adapted to be opened/closed automatically.

2. Description of the Related Art

TW Pat. No. 1542786 discloses an air pump for tubeless tires. The air pump includes a pumping system and a storage tank fluidly connected to the pumping system to store air generated by the pumping system. The air pump further includes a closure device for selectively discharging air out of the air reservoir. However, the closure device is manually controlled.

The present invention is, therefore, intended to obviate or at least alleviate the problems encountered in the prior art.

SUMMARY OF THE INVENTION

According to the present invention, an air pump includes a pumping system, a storage tank, a discharge passage, and a valve. The pumping system includes a cylinder. The storage tank is connected to the cylinder and includes an inlet port for receiving air generated by the pumping system and an outlet port. The discharge passage is connected to the outlet port and extends axially. The discharge passage includes a first section and a second section wider than the first section. The valve is movable in the discharge passage between a first position and a second position. The valve, disposed in the first position, includes a first seal end disposed in the first section and abutting a periphery thereof and includes a second seal end disposed in the second section and abutting a periphery thereof. The valve, disposed in the second position, includes the first seal end disengaging from the first section and not abutting the periphery thereof and includes the second seal end disposed in the second section and abutting the periphery thereof. The first and second seal ends respectively have first and second cross-sectional areas. The ratio of the second cross-sectional area to the first cross-sectional area is at least 2 to 1.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is an objective of the present invention to provide an air pump including a pumping system and a storage tank fluidly connected to the pumping system and including an automatic opening/closing outlet port.

Other objectives, advantages, and new features of the present invention will become apparent from the following detailed description of the invention when considered in conjunction with the accompanied drawings.

DETAILED DESCRIPTION OF THE INVENTION

Figure 1:
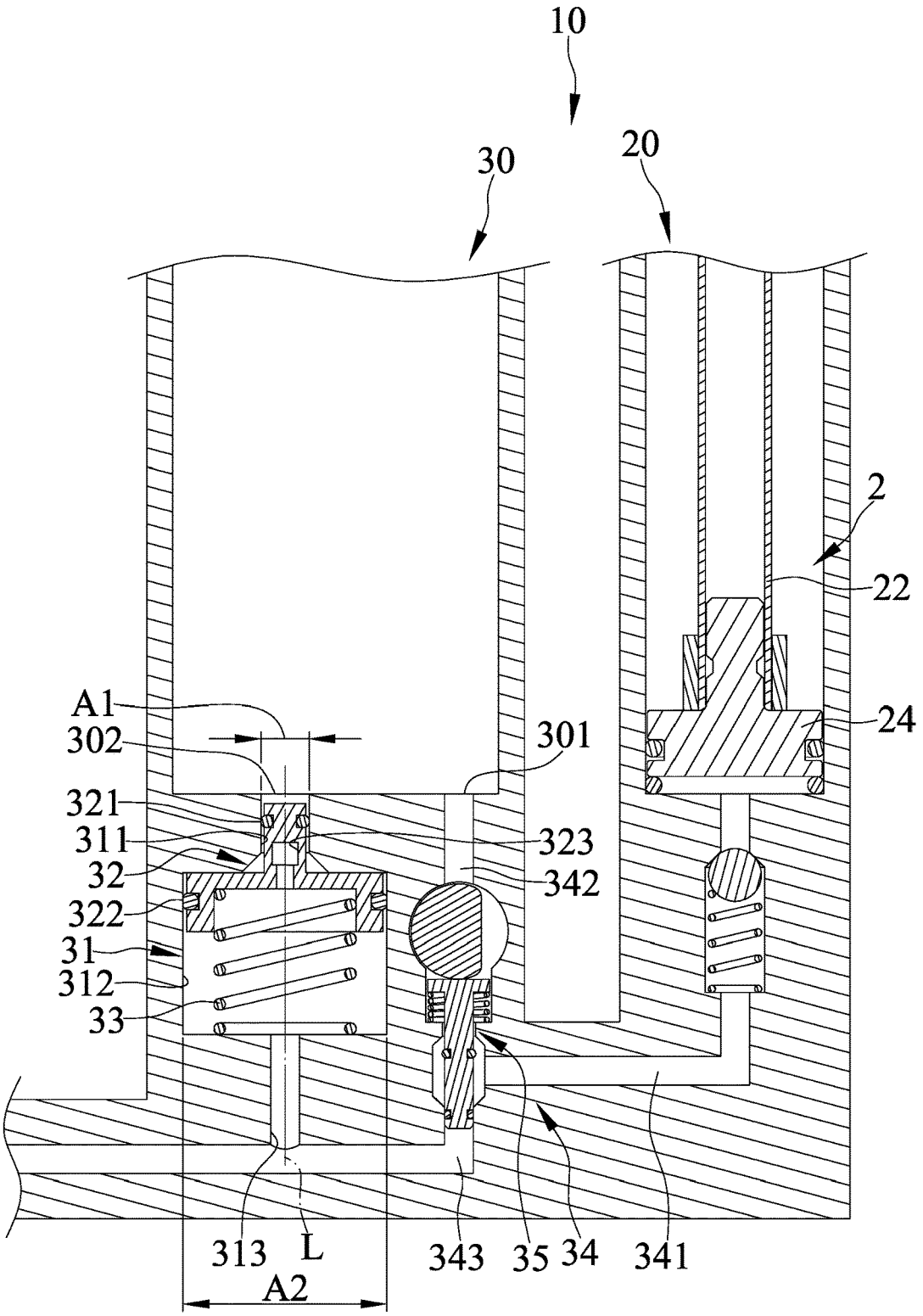
FIG. 1 is a partial, cross-sectional view of an air pump in accordance with the present invention.

An air pump 10 includes a pumping system 2, a storage tank 30, a discharge passage 31, and a valve 32.

The pumping system 2 includes a cylinder 20, a plunger 22, and a piston 24 coupled to an end of the plunger 22. The piston 24 is disposed in the cylinder 20. The piston 24 is reciprocally movable in the cylinder 20 and is operated by the plunger 22.

The storage tank 30 is connected to the cylinder 20 and includes an inlet port 301 for receiving air generated by the pumping system 2 and an outlet port 302.

The discharge passage 31 is connected to the outlet port 302 and extends axially. The discharge passage 31 extends axially and longitudinally along an axis L. The discharge passage 31 includes a first section 311 and a second section 312 and extends from the first section 311 to the second section 312 along the axis L. The second section 312 is wider than the first section 311 in a width direction of the discharge passage 31, which is perpendicular to the axis L.

The valve 32 is movable in the discharge passage 31 between a first position and a second position. The valve 32, disposed in the first position, includes a first seal end 321 disposed in the first section 311 and abutting a periphery thereof and includes a second seal end 322 disposed in the second section 312 and abutting a periphery thereof. The valve 32, disposed in the second position, includes the first seal end 321 disengaging from the first section 311 and not abutting the periphery thereof and includes the second seal end 322 disposed in the second section 312 and abutting the periphery thereof.

The first and second seal ends 321 and 322 respectively have first and second cross-sectional areas A1 and A2. The ratio of the second cross-sectional area A2 to the first cross-sectional area A1 is at least 2 to 1. It is also contemplated that the ratio of second cross-sectional area A2 to the first cross-sectional area A1 is at least 10 to 1.

The valve 32 has a middle portion extending between the first seal end 321 and the second seal end 322. The valve 32 includes a hole 323 extending through the middle portion and defining two open ends.

A biasing member 33 acts on the valve 32 in a direction towards the outlet port 302. The discharge passage 31 has an outlet end 313 defining an opening on a wall of the second section 312. The second section 312 is wider than the opening. The biasing member 33 includes an end abutting the valve 32 and another end abutting the wall.

A passage 34 allows air to flow out of the air pump 10. The passage 34 has a first end connected to the cylinder 20, a second end connected to the inlet port 301 of the storage tank 30, and a third end connected to the outlet end 313. The passage 34 includes a first passage 341 having one distal end connected to the cylinder 20 and another distal end bifurcating into a second passage 342 and a third passage 343. The second passage 342 has one distal end connected to the first passage 341 and another distal end connected to the inlet port 301. The third passage 343 has one distal end connected to the first passage 341, a middle end connected to the outlet end 313, and another distal end that allows air to flow out of the air pump 10. The control 35 is disposed in the second passage 342. The second passage 342 includes a narrower section and a wider section and defines an orifice between the narrower and wider sections.

The passage 34 includes a control 35 disposed therein. The control 35 is operable for selectively stopping air flowing into the storage tank 30 through the inlet port 301. The control 35 includes a plug 37 engaging in the orifice, a second biasing member 39 including one end abutting the plug 37 and another end abutting a wall of the wider section, and a cam 41 acting on the plug 37 and counteracting the second biasing member 39.

A one-way seal device 43 is disposed in the passage 34. The one-way seal device 43 prevents air flowing in the passage 34 flowing reversely into the cylinder 20. The one way seal device 43 includes a block 45 and a biasing member 47 biasing the block 45. The one-way seal device 43 is located between the pumping system 2 and the control 35.

Figure 2:
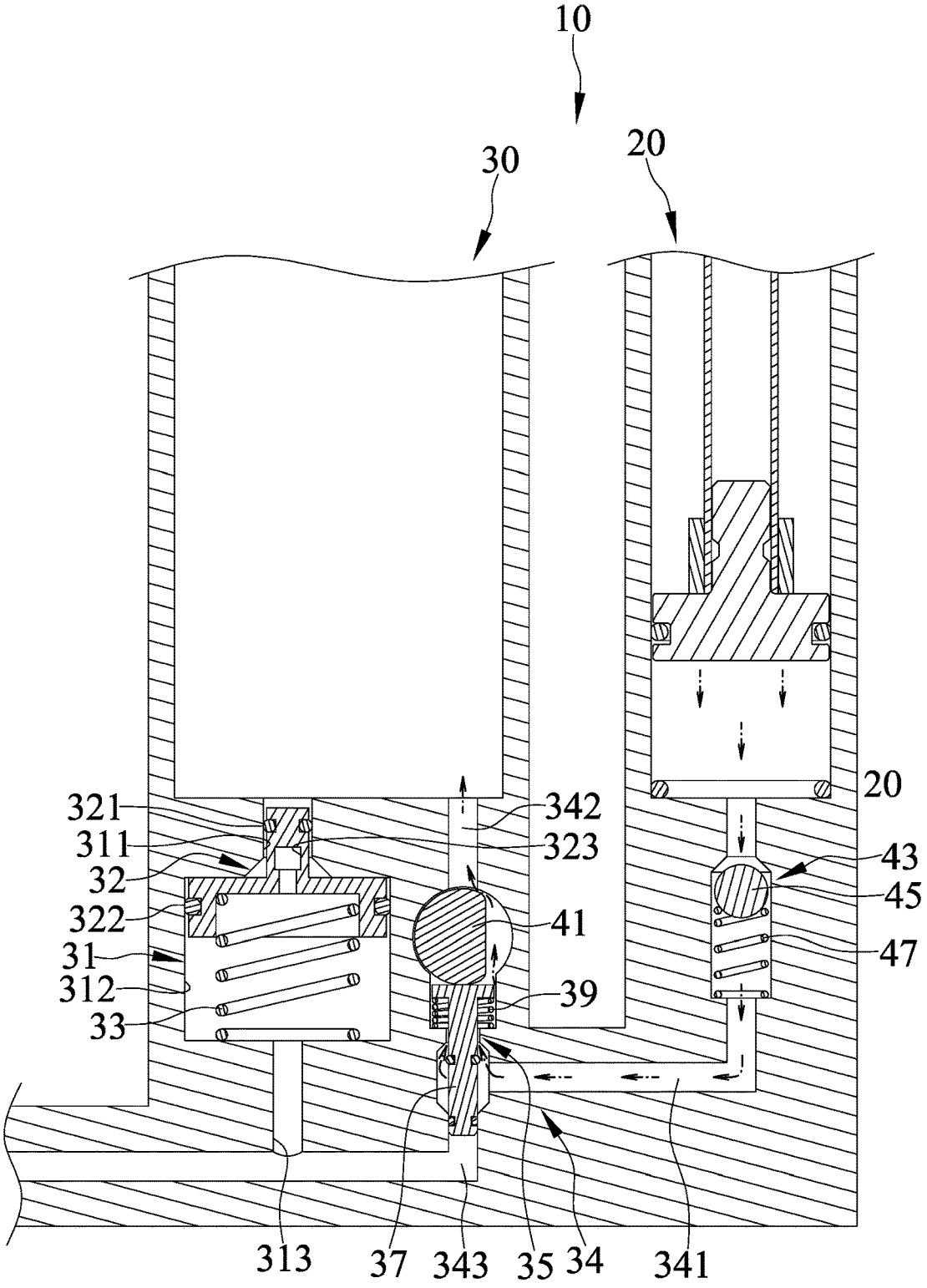
FIG. 2 is a partial, cross-sectional view showing the air pump including a pumping system generating air and which is delivered to and is stored within a storage tank, with a control in a first position.
Figure 4:
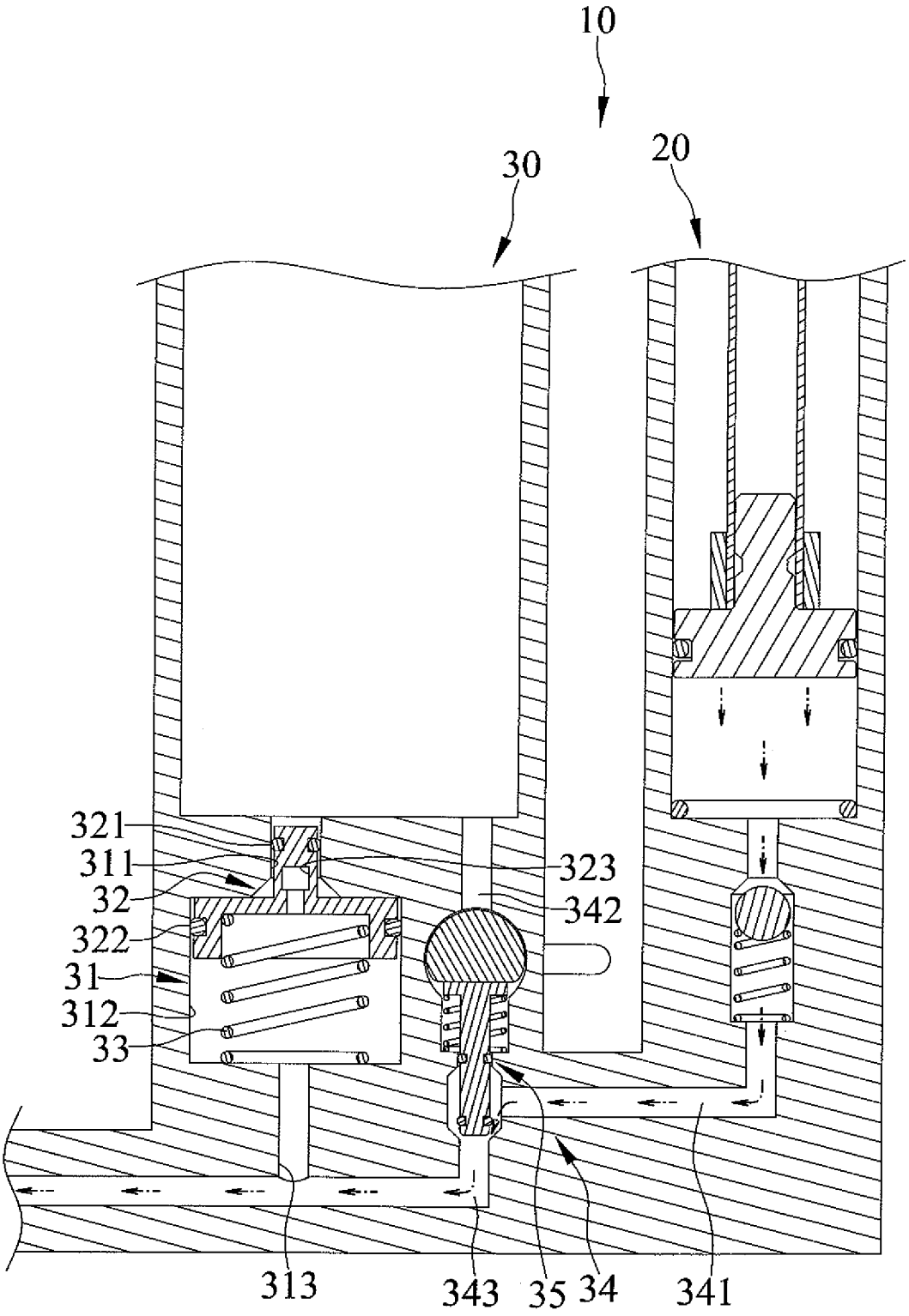
FIG. 4 is a partial, cross-sectional view showing the pumping system generating air and which flows bypass the storage tank, with the control in a second position.

When the control 35 is disposed in a first position, as shown in FIG. 2, air is pumped into the storage tank 30 via the first and second passages 341 and 342 upon operation of the pumping system 2. Furthermore, when the control 35 is disposed in a second position, as shown in FIG. 4, air is pumped out of the air pump 10 via the first and third passages 341 and 343 upon operation of the pumping system 2.

Figure 3:
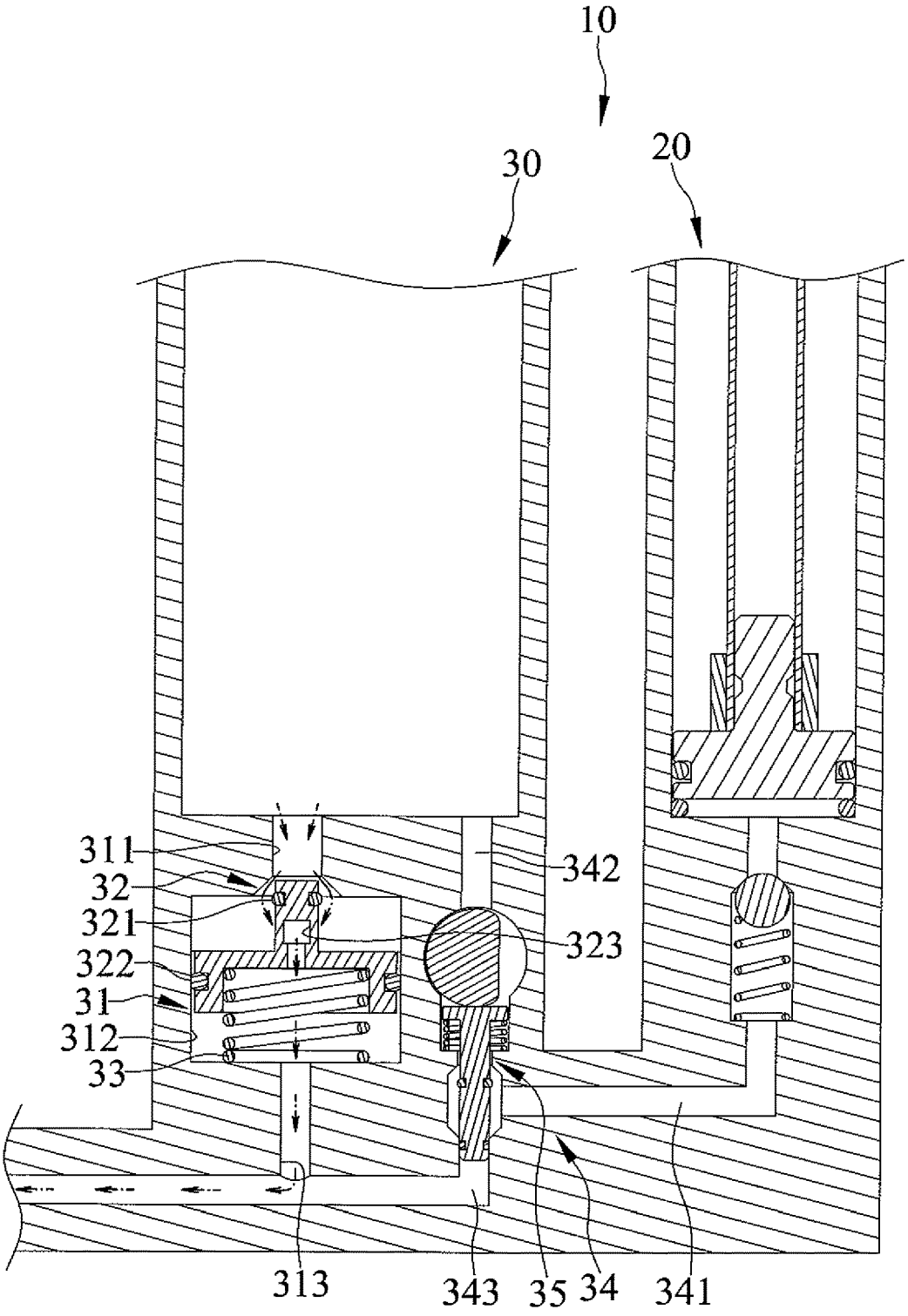
FIG. 3 is a partial, cross-sectional view showing the pusher disposed in the first position as well as air discharging out of the storage tank and the outlet port of the storage tank in an open position.

As shown in FIG. 2, as the pumping system 2 pumps air into the storage tank 30, the pressure inside the storage tank 30 increases. When the pressure is not high enough, air is unable to overwhelm the biasing member 33 to urge the valve 32 from the first position to the second position. The valve 32, disposed in the first position, stops air in the storage tank 30 flowing out of the outlet port. As shown in FIG. 3, when the storage tank 30 stores sufficient volumes of air and the pressure inside is high enough, air can supply enough force to urge the valve 32 to the second position. The valve 32, disposed in the second position, allows air in the storage tank 30 to flow out of the outlet port 302 and into the discharge passage 31. Furthermore, when the first seal end 321 disengages from the first section 311, a gap is created between the first seal end 321 and the periphery of the second section 312. The hole 323 includes one open end connected to the gap and another open end connected to the second section 312. Therefore, air in the storage tank 30 flows out of the outlet port 302, and into the discharge passage 31 through the gap and the open ends of the hole. Furthermore, as the volumes of air inside the storage tank 30 decrease, the valve 32 will start moving from the second position to the first position.

In view of the forgoing, the outlet port 302 of the storage tank 30 can be opened/closed automatically by the valve 32. When the control 35 is disposed in the first position, air is pumped into the storage tank 30 upon operation of the pumping system 2. Furthermore, when the control 35 is disposed in the second position, air is pumped out of the air pump 10 upon operation of the pumping system 2.

The foregoing is merely illustrative of the principles of this invention, and various modifications can be made by those skilled in the art without departing from the scope and spirit of the invention.

What is claimed is:

1. A air pump comprising:

a pumping system including a cylinder;

a storage tank connected to the cylinder and including an inlet port for receiving air generated by the pumping system and an outlet port;

a discharge passage connected to the outlet port and extending axially, wherein the discharge passage includes a first section and a second section wider than the first section; and a valve being movable in the discharge passage between a first position and a second position, wherein the valve, disposed in the first position, includes a first seal end disposed in the first section and abutting a periphery thereof and includes a second seal end disposed in the second section and abutting a periphery thereof, wherein the valve, disposed in the second position, includes the first seal end disengaging from the first section and not abutting the periphery thereof and includes the second seal end disposed in the second section and abutting the periphery thereof, wherein the first and second seal ends respectively have first and second cross-sectional areas, and wherein the ratio of the second cross-sectional area to the first cross-sectional area is at least 2 to 1, wherein the valve has a middle portion extending between the first seal end and the second seal end, and wherein the valve includes a hole extending through the middle portion and defining two open ends.

2. The air pump as claimed in claim 1, wherein the ratio of the second cross-sectional area to the first cross-sectional area is at least 10 to 1.

3. The air pump as claimed in claim 2, wherein the valve has a middle portion extending between the first seal end and the second seal end, and wherein the valve includes a hole extending through the middle portion and defining two open ends.

4. The air pump as claimed in claim 1 further comprising a biasing member acting on the valve in a direction towards the outlet port, wherein the discharge passage has an outlet end defining an opening on a wall of the second section, wherein the second section is wider than the opening, and wherein the biasing member includes an end abutting the valve and another end abutting the wall.

5. The air pump as claimed in claim 4 further comprising a passage allowing air to flow thereout, wherein the passage has a first end connected to the cylinder, a second end connected to the inlet port of the storage tank, and a third end connected to the outlet end, and wherein the passage includes a control disposed therein and being operable for selectively stopping air flowing into the storage tank through the inlet port.

6. The air pump as claimed in claim 5, wherein the passage includes a first passage having one distal end connected to the cylinder and another distal end bifurcating into a second passage and a third passage, with the second passage having one distal end connected to the first passage and another distal end connected to the inlet port, with the third passage having one distal end connected to the first passage, a middle end connected to the outlet end, and another distal end that allows air to flow out of the air pump.

7. The air pump as claimed in claim 5, wherein the control includes a plug, a second biasing member acting on the plug in a first direction, and a cam acting on the plug in a second direction opposing the first direction.

8. The air pump as claimed in claim 6, wherein the control is disposed in the second passage, wherein the second passage includes a narrower section and a wider section and defines an orifice between the narrower and wider sections, wherein the control includes a plug engaging in the orifice, a second biasing member including one end abutting the plug and another end abutting a wall of the wider section, and a cam acting on the plug and counteracting the second biasing member.

9. The air pump as claimed in claim 7, wherein the pumping system includes a plunger and a piston coupled to an end of the plunger, wherein the piston is disposed in the cylinder, and wherein the piston is reciprocally movable in the cylinder and is operated by the plunger.

10. The air pump as claimed in claim 9 further comprising a one-way seal device disposed in the passage, wherein the one-way seal device is located between the pumping system and the control.

11. The air pump as claimed in claim 3 further comprising a biasing member acting on the valve in a direction towards the outlet port, wherein the discharge passage has an outlet end defining an opening on a wall of the second section, wherein the second section is wider than the opening, and wherein the biasing member includes an end abutting the valve and another end abutting the wall.

12. The air pump as claimed in claim 11 further comprising a passage allowing air to flow thereout, wherein the passage has a first end connected to the cylinder, a second end connected to the inlet port of the storage tank, and a third end connected to the outlet end, and wherein the passage includes a control disposed therein and being operable for selectively stopping air flowing into the storage tank through the inlet port.

13. The air pump as claimed in claim 12, wherein the passage includes a first passage having one distal end connected to the cylinder and another distal end bifurcating into a second passage and a third passage, with the second passage having one distal end connected to the first passage and another distal end connected to the inlet port, with the third passage having one distal end connected to the first passage, a middle end connected to the outlet end, and another distal end that allows air to flow out of the air pump.

14. The air pump as claimed in claim 12, wherein the control includes a plug, a second biasing member acting on the plug in a first direction, and a cam acting on the plug in a second direction opposing the first direction.

15. The air pump as claimed in claim 13, wherein the control is disposed in the second passage, wherein the second passage includes a narrower section and a wider section and defines an orifice between the narrower and wider sections, wherein the control includes a plug engaging in the orifice, a second biasing member including one end abutting the plug and another end abutting a wall of the wider section, and a cam acting on the plug and counteracting the second biasing member.

16. The air pump as claimed in claim 14, wherein the pumping system includes a plunger and a piston coupled to an end of the plunger, wherein the piston is disposed in the cylinder, and wherein the piston is reciprocally movable in the cylinder and is operated by the plunger.

17. The air pump as claimed in claim 16 further comprising a one-way seal device disposed in the passage, wherein the one-way seal device is located between the pumping system and the control.

* * * * *